US007331366B1

(12) United States Patent
Patterson

(10) Patent No.: US 7,331,366 B1
(45) Date of Patent: Feb. 19, 2008

(54) MONEY AND CARD HOLDING ASSEMBLY

(76) Inventor: Brian A. Patterson, 20709 N. 264th Ave., Buckeye, AZ (US) 85396

( * ) Notice: Subject to any disclaimer, the term of this patent is extended or adjusted under 35 U.S.C. 154(b) by 184 days.

(21) Appl. No.: 11/140,045

(22) Filed: May 31, 2005

(51) Int. Cl.
*A45C 11/18* (2006.01)

(52) U.S. Cl. ..... 150/149; 150/147; 206/39

(58) Field of Classification Search ..... 50/131–134, 50/137, 147–149; 206/37, 38, 39, 39.7
See application file for complete search history.

(56) References Cited

U.S. PATENT DOCUMENTS

| | | | | | |
|---|---|---|---|---|---|
| 979,806 | A * | 12/1910 | Snyder | 150/136 |
| 1,223,946 | A * | 4/1917 | Fenigstein | 206/37 |
| 2,031,773 | A * | 2/1936 | Halperin | 206/37 |
| 3,369,585 | A * | 2/1968 | Martinsen | 206/37 |
| 3,648,832 | A * | 3/1972 | Kirshenbaum et al. | 206/37 |
| 3,856,063 | A | 12/1974 | Dengel | |
| 3,946,781 | A | 3/1976 | Reis | |
| 4,194,655 | A | 3/1980 | Tillotson | |
| 4,768,648 | A * | 9/1988 | Glass | 206/38 |
| 4,817,253 | A * | 4/1989 | Harmatuik | 24/458 |
| 5,115,909 | A | 5/1992 | Hull et al. | |
| 5,452,793 | A * | 9/1995 | DiMeo et al. | 206/39 |
| 5,560,476 | A * | 10/1996 | Lee | 206/38 |
| 5,725,098 | A | 3/1998 | Seifert et al. | |
| 5,740,624 | A * | 4/1998 | Baseley | 40/649 |
| 5,913,618 | A | 6/1999 | Yosha | |
| 6,039,175 | A | 3/2000 | Wright | |
| 6,240,989 | B1 * | 6/2001 | Masoud | 150/149 |
| 6,871,682 | B2 * | 3/2005 | Hogganvik | 150/149 |
| 2003/0230514 | A1 * | 12/2003 | Baker | 206/732 |

* cited by examiner

*Primary Examiner*—Sue A. Weaver

(57) ABSTRACT

A money and card holding assembly includes a housing that has a bottom wall, a top wall and a peripheral wall. The peripheral wall has a peripheral break therein positioned generally equidistant from the top and bottom walls so that a top portion and a bottom portion of the housing are defined. A hinge hingedly couples the top portion to the bottom portion so that the top and bottom portions may selectively be positioned in an open position or a closed position. The hinge hingedly couples an upper portion of the back wall to a lower portion of the back wall. A first plate is attached to the lower portion of the back wall and is biased toward the bottom wall. A second plate is attached to upper portion of the back wall and is biased to the top wall.

5 Claims, 3 Drawing Sheets

MONEY AND CARD HOLDING ASSEMBLY

BACKGROUND OF THE INVENTION

1. Field of the Invention

The present invention relates to card holding devices and more particularly pertains to a new card holding device for holding both charge cards and paper money.

2. Description of the Prior Art

The use of card holding devices is known in the prior art. U.S. Pat. No. 5,115,909 describes a clip device for holding money and the like. Another type of card holding device is U.S. Pat. No. 5,913,618 describes a device for holding both money and charge cards within a clip. A device having a more typical wallet construction is shown in U.S. Pat. No. 3,946,781 which includes a plurality of pockets which are configured for holding a plurality credit cards and which includes additional pockets for holding paper money.

While these devices fulfill their respective, particular objectives and requirements, the need remains for a device that has a relatively small size but which is able to hold money and charge cards in a secured manner. Additionally, the device should be adapted for holding the money and cards in a manner that keeps them separate from each other.

SUMMARY OF THE INVENTION

The present invention meets the needs presented above by generally comprising a housing that has a bottom wall, a top wall and a peripheral wall that is attached to and extends between the top and bottom walls. The peripheral wall includes a front wall, a back wall and a pair of lateral walls. The peripheral wall has a peripheral break therein positioned generally equidistant from the top and bottom walls so that a top portion and a bottom portion of the housing are defined. A hinge hingedly couples the top portion to the bottom portion so that the top and bottom portions may selectively be positioned in an open position or a closed position. The hinge hingedly couples an upper portion of the back wall to a lower portion of the back wall. A first plate is attached to the lower portion of the back wall and is biased toward the bottom wall. A second plate is attached to upper portion of the back wall and is biased to the top wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
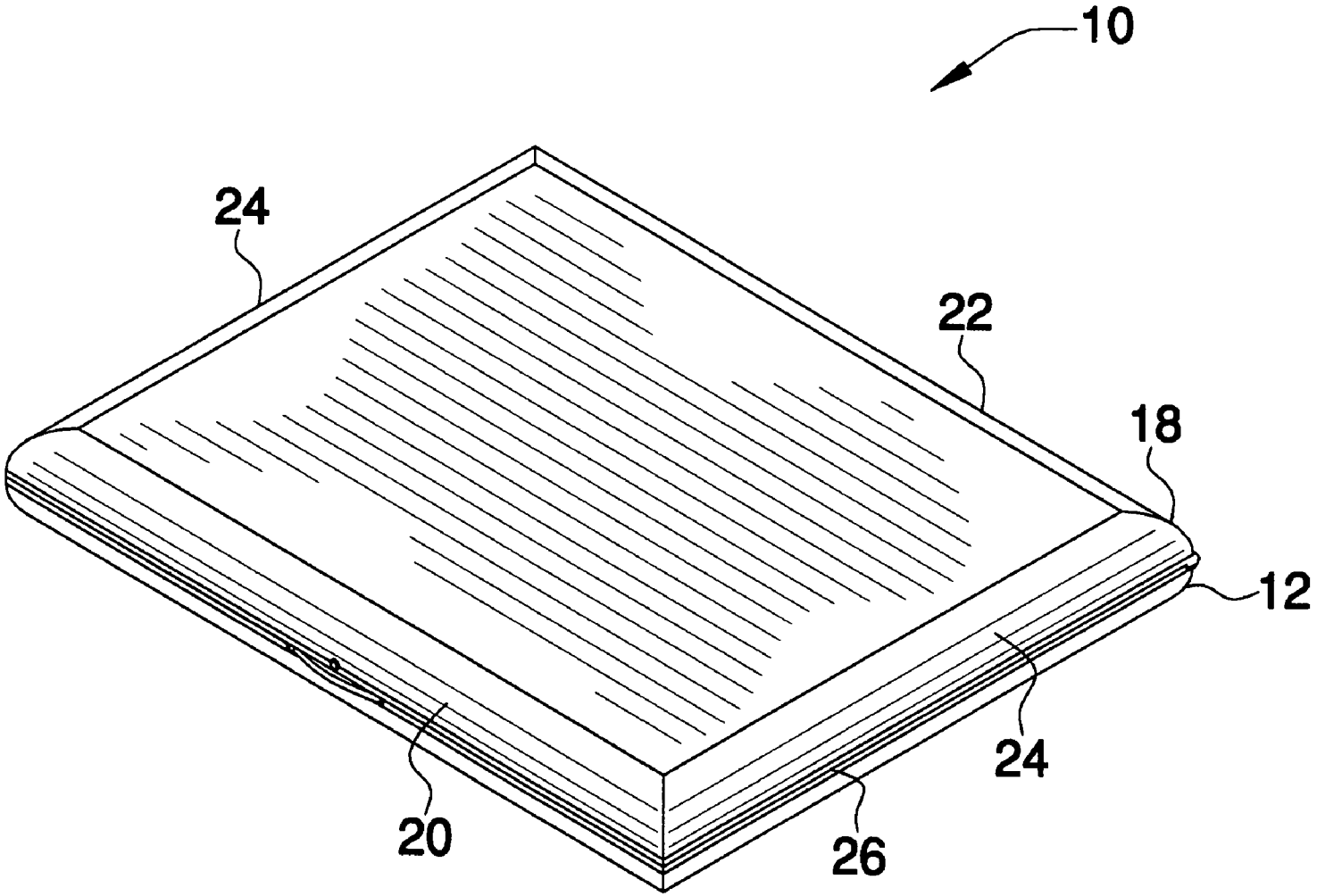
FIG. 1 is a perspective view of a money and card holding assembly according to the present invention.
Figure 2:
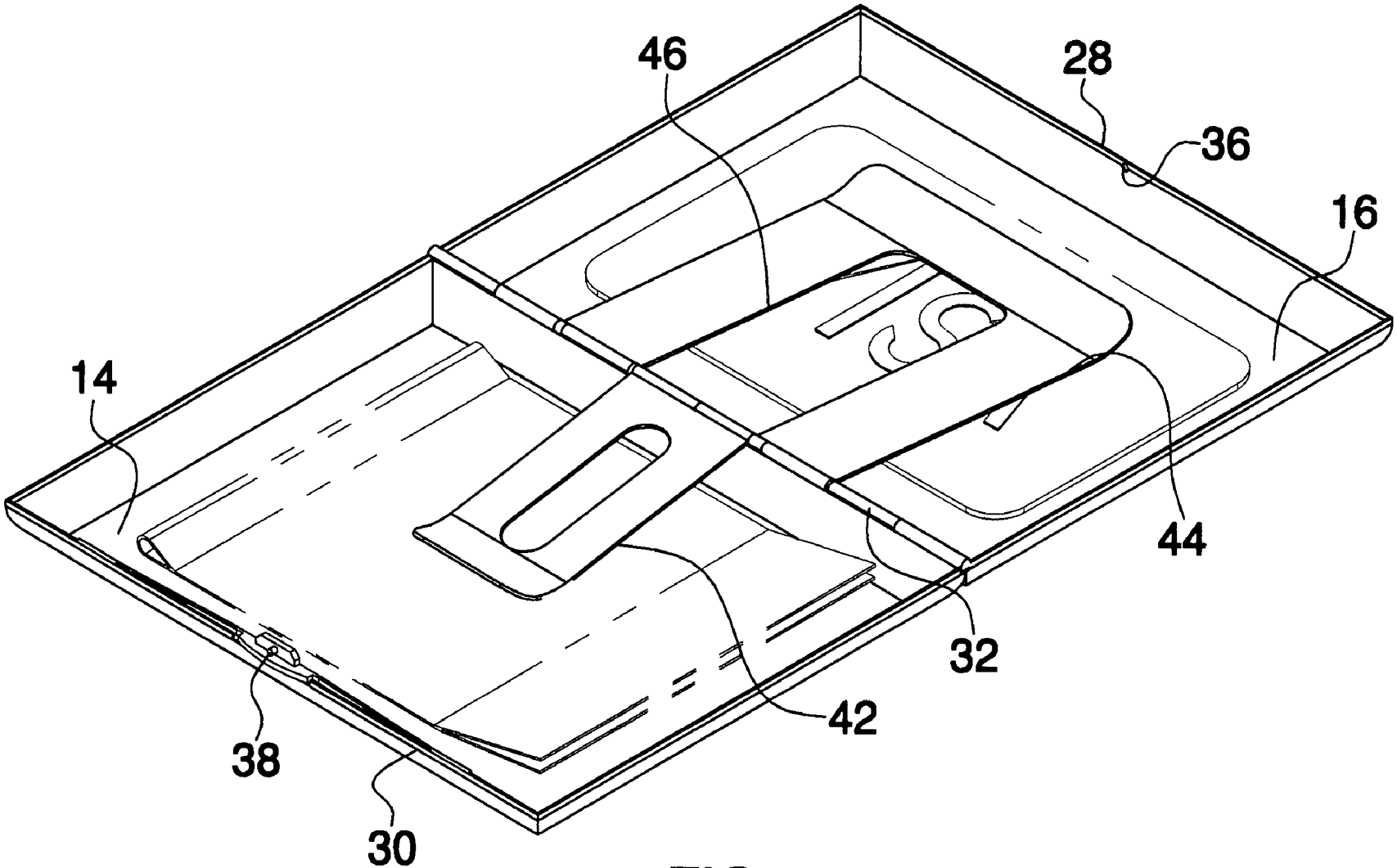
FIG. 2 is a perspective view of the present invention.
Figure 3:
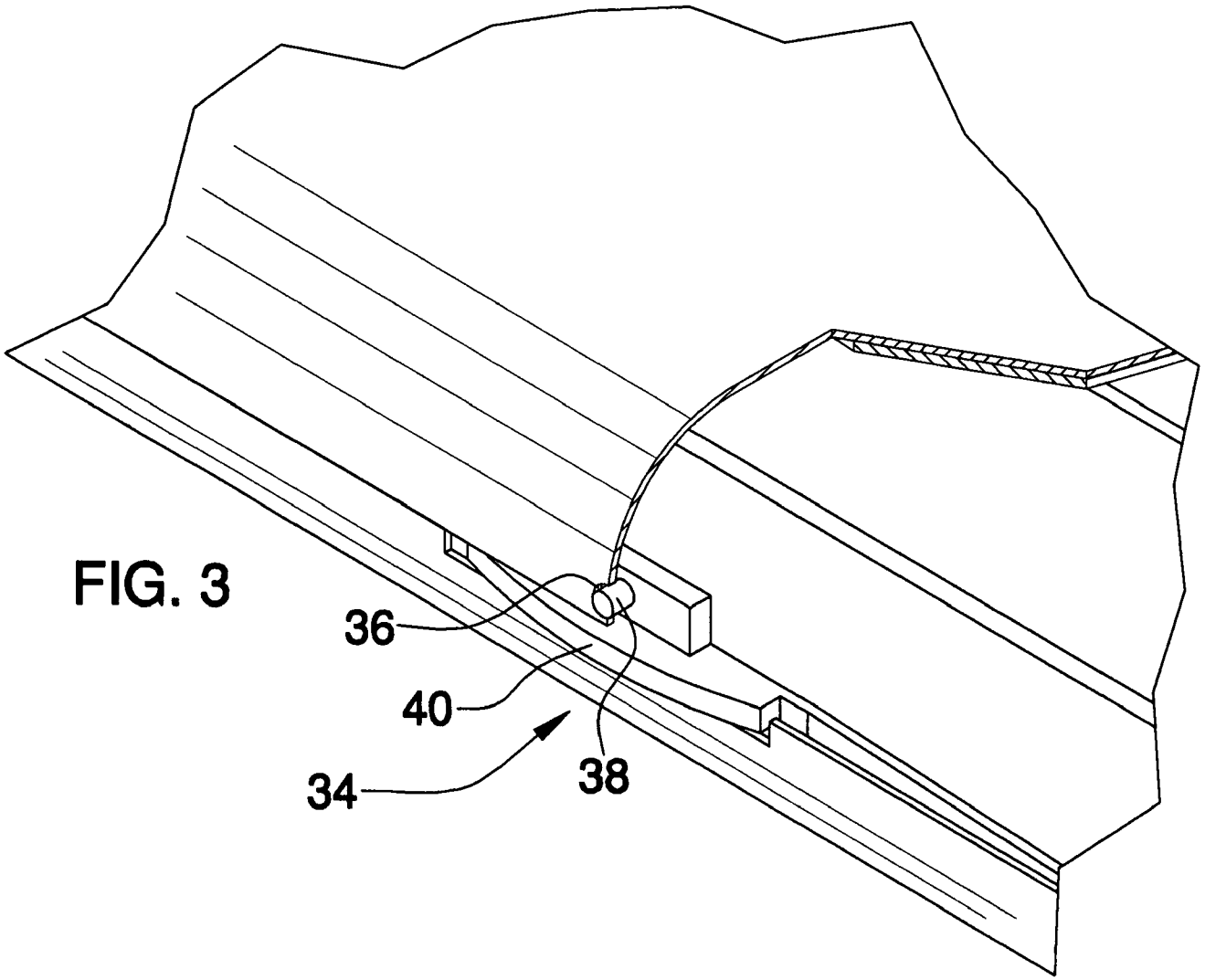
FIG. 3 is an enlarged broken view of the present invention.

With reference now to the drawings, and in particular to FIGS. 1 through 3 thereof, a new card holding device embodying the principles and concepts of the present invention and generally designated by the reference numeral 10 will be described.

As best illustrated in FIGS. 1 through 3, the money and card holding assembly 10 generally comprises a housing 12 that has a bottom wall 14, a top wall 16 and a peripheral wall 18 that is attached to and extends between the top 16 and bottom 14 walls. The peripheral wall 18 includes a front wall 20, a back wall 22 and a pair of lateral walls 24. The peripheral wall 18 has a peripheral break 26 therein positioned generally equidistant from the top 16 and bottom 14 walls so that a top portion 28 and a bottom portion 30 of the housing 12 are defined. A hinge 32 hingedly couples the top portion 28 to the bottom portion 30 so that the top 28 and bottom 30 portions may selectively be positioned in an open position or a closed position. The hinge 32 hingedly couples an upper portion of the back wall 22 to a lower portion of the back wall 22. The housing 12 has a height generally between 5/16 inch and ¾ inch, a length between the lateral walls is generally between 3½ inches and 4 inches, and a width from the front wall to the back wall generally between 2½ inch and 3 inches.

A locking member 34 is configured to releasably secure the housing 12 in the closed position. The locking member 34 includes first 36 and second 38 complimentary members. The first complimentary member 36 is mounted in an upper portion of the front wall 20 and the second complimentary member 38 is mounted in a lower portion of the front wall 20. The first 36 and second 38 complimentary members are releasably couplable together. The secondary complimentary member 38 comprises a male coupler that is directed outwardly away from the front wall 20. The male coupler is mounted to a panel 40 that is biased away from the back wall 22. The first complimentary member 38 comprises a female coupler positioned for receiving the male coupler. The male coupler may be urged toward the back wall 22 so that the male coupler is released from the female coupler.

A first plate 42 is attached to the lower portion 30 of the back wall 22 and is biased toward the bottom wall 14. A second plate 44 is attached to upper portion 28 of the back wall 22 and is biased to the top wall 16. The second plate 44 has a centrally positioned opening 46 therein. The opening 46 is a same size and shape as the first plate 42. The first 42 and second 44 plates may be biased by being attached to the housing 12 or a spring mounted on the hinge 32.

In use, one of the plates 42, 44 functions as a clip to secure credit cards in the housing 12 and one of the plates 42, 46 functions as a clip to secure money in the housing 12. The housing 12 may then be secured in a closed position to prevent the cards and money from falling outwardly of the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A charge card and money holder assembly comprising:

a housing having a bottom wall, a top wall and a peripheral wall being attached to and extending between said top and bottom walls, said peripheral wall including a front wall, a back wall and a pair of lateral walls, said peripheral wall having a peripheral break therein positioned generally equidistant from said top and bottom walls such that a top portion and a bottom portion of said housing are defined, a hinge hingedly couples said top portion to said bottom portion such that said top and bottom portions may selectively be positioned in an open position or a closed position, said hinge hingedly coupling an upper portion of said back wall to a lower portion of said back wall;

a first plate being attached to said lower portion of said back wall and being biased toward said bottom wall; and a second plate being attached to upper portion of said back wall and being biased to said top wall, said second plate has a centrally positioned opening therein, said opening being a same size and shape as said first plate, said opening receiving a raised portion of said first plate when said housing is in said closed position.

2. The assembly according to claim 1, wherein said housing has a height generally between 5/16 inch and 3/4 inch, a length of said housing between said lateral walls being generally between 3½ inches and 4 inches, and a width from said front wall to said back wall generally between 2½ inch and 3 inches.

3. The assembly according to claim 1, further including a locking member being configured to releasably secure said housing in said closed position.

4. The assembly according to claim 3, wherein said locking member includes first and second complimentary members, said first complimentary member being mounted in an upper portion of said front wall, said second complimentary member being mounted in a lower portion of said front wall, said first and second complimentary members being releasably couplable together.

5. A charge card and money holder assembly comprising:

a housing having a bottom wall, a top wall and a peripheral wall being attached to and extending between said top and bottom walls, said peripheral wall including a front wall, a back wall and a pair of lateral walls, said peripheral wall having a peripheral break therein positioned generally equidistant from said top and bottom walls such that a top portion and a bottom portion of said housing are defined, a hinge hingedly couples said top portion to said bottom portion such that said top and bottom portions may selectively be positioned in an open position or a closed position, said hinge hingedly coupling an upper portion of said back wall to a lower portion of said back wall, said housing having a height generally between 5/16 inch and /3;4 inch, a length of said housing between said lateral walls being generally between 3½ inches and 4 inches, and a width from said front wall to said back wall generally between 2½ inch and 3 inches;

a locking member being configured to releasably secure said housing in said closed position, said locking member including first and second complimentary members, said first complimentary member being mounted in an upper portion of said front wall, said second complimentary member being mounted in a lower portion of said front wall, said first and second complimentary members being releasably couplable together;

a first plate being attached to said lower portion of said back wall and being biased toward said bottom wall, said first plate having an attached end attached to said lower portion of said back wall and a free end positioned distal of said attached end; and a second plate being attached to upper portion of said back wall and being biased to said top wall, said second plate having a centrally positioned opening therein, said opening being a same size and shape as said first plate, said opening receiving a raised portion of said first plate when said housing is in said closed position, said raised portion including said free end of said first plate.

* * * * *